US006101655A

United States Patent [19]

Buddle

[11] Patent Number: 6,101,655

[45] Date of Patent: Aug. 15, 2000

[54] DEVICE FOR PREVENTING SLIPPAGE OF HEEL OF WOMAN'S SHOE, MOLDED HEEL CUP AND METHOD OF FORMING DEVICE AND MOLDED HEEL CUP

[75] Inventor: Robert Buddle, Naples, Fla.

[73] Assignee: Heart & Sole Software, Inc., Naples, Fla.

[21] Appl. No.: 09/226,183

[22] Filed: Jan. 7, 1999

Related U.S. Application Data

[60] Provisional application No. 60/074,214, Jan. 10, 1998.

[51] Int. Cl.[7] ..... A43D 11/00; A43B 23/28

[52] U.S. Cl. ..... 12/146 C; 12/146 D; 36/58.5; 36/71

[58] Field of Search ..... 36/71, 80, 58.5, 36/58.6; 12/146 D, 146 C

[56] References Cited

U.S. PATENT DOCUMENTS

| | | | |
|---|---|---|---|
| 32,487 | 6/1861 | Plumer . | |
| 1,018,652 | 2/1912 | Drechsler . | |
| 1,028,586 | 6/1912 | McMullan . | |
| 1,138,473 | 5/1915 | Hedgecock . | |
| 1,392,628 | 10/1921 | Drechsler . | |
| 1,417,170 | 5/1922 | Hosmer . | |
| 1,544,625 | 7/1925 | Austin . | |
| 1,566,791 | 12/1925 | Ekins | 36/58.5 |
| 1,712,420 | 5/1929 | Carlson | 36/58.5 |
| 1,749,084 | 3/1930 | McCarthy . | |
| 1,767,229 | 6/1930 | Scholl . | |
| 1,812,622 | 6/1931 | Costello . | |
| 1,878,419 | 9/1932 | McCarthy . | |
| 1,900,107 | 3/1933 | Handler | 36/58.5 |
| 1,966,179 | 7/1934 | Lesch . | |
| 2,031,510 | 2/1936 | Stewart et al. . | |
| 2,045,844 | 6/1936 | Everston . | |
| 2,083,390 | 6/1937 | Murena . | |
| 2,210,332 | 8/1940 | Eich . | |
| 2,275,191 | 3/1942 | Schwartz et al. . | |
| 2,379,000 | 6/1945 | Gould . | |
| 2,489,429 | 11/1949 | Nathan . | |
| 3,373,513 | 3/1968 | Jewell . | |
| 4,235,028 | 11/1980 | Riggs . | |
| 5,632,103 | 5/1997 | Suenaga . | |

FOREIGN PATENT DOCUMENTS

| | | | |
|---|---|---|---|
| 299249 | 10/1928 | United Kingdom | 36/58.5 |

*Primary Examiner*—M. D. Patterson
*Attorney, Agent, or Firm*—Oblon, Spivak, McClelland, Maier & Neustadt, P.C.

[57] ABSTRACT

A foot gripping device is provided which utilizes a combination of a heel cup outsole formed of a semi-rigid material that stabilizes an orthotic or orthotic insert within a shoe in order to receive the heel of the wearer during a normal gate of the individual. Pockets are created on the inner side portions of a last for the shoe within which air/foam inserts are positionable and are securable by a sheeting member which is secured by adhesives and/or stitching to the inner side portion of the shoe. A second foot gripping device for a shoe includes a heel portion having a counter with an inner lining into which a heel of an individual is positionable, at least one strip of material secured to the lining wherein the strip of material forms a tunnel which is open at at least one end thereof, and an insert removably positioned within the tunnel, the insert reducing a width dimension of an opening of the heel portion of the shoe and being engageable with a side portion of the heel of the individual to resist slippage of the heel of the individual from the shoe. A heel cup is also provided which is in the form of a heel cup support for a shoe which includes either a midsole or outsole, the midsole or outsole having a cup portion extending from the heel portion of the shoe to a position in proximity with the arch portion of the shoe so as to provide greater comfort and support to the heel of the individual wearing the shoe. A method of resisting slippage of the heel portion of the shoe and a method of constructing a shoe having the cup portion is also provided.

6 Claims, 11 Drawing Sheets

DEVICE FOR PREVENTING SLIPPAGE OF HEEL OF WOMAN'S SHOE, MOLDED HEEL CUP AND METHOD OF FORMING DEVICE AND MOLDED HEEL CUP

This application is partially based on U.S. Provisional Application No. 60/074,214 filed Jan. 10, 1998, the benefit of which is hereby claimed under 35 USC 119(e).

BACKGROUND OF THE INVENTION

1. Field of the Invention

The present invention is directed to a device for preventing slippage of the heel of a woman's shoe and providing a molded heel cup, as well as a method of forming the device and of forming the molded heel cup. The normal gate of individuals includes a series of movements from heel contact, pronation motion through to forefoot pressure and finally propultion and swing of the foot. Problems are often experienced, however, as shoes worn by individuals have a tendency to slip off of the foot unless the foot of the individual is properly secured within the shoe.

2. Discussion of the Background

Shoe retaining devices known in the art include U.S. Pat. 1,018,652; U.S. Pat. No. 1,138,473; U.S. Pat. No. 1,392,628; U.S. Pat. No. 1,812,622; U.S. Pat. No. 1,028,586 and U.S. Pat. No. 1,878,419. These retainer devices are plagued by difficulties in installation and in replaceability thereof, however, due to the fact that in each of these devices, the retainer is fixedly secured to an interior portion of the shoe such that removal of the retainer and/or replacement with a substitute retainer requires complete replacement of the material within which the retainer is housed or by which the retainer is fixed to the shoe.

Shoe constructions arc also known which provide for a recessed area formed in the insole of a shoe in proximity with the heel portion thereof, as exemplified by U.S. Pat. No. 2,379,000; U.S. Pat. No. 2,210,332; U.S. Pat. No. 1,417,170; U.S. Pat. No. 1,544,065 and U.S. Pat. No. 32,487. The disclosure of each of the above-noted applications is incorporated herein by reference since such exemplifies the background art related to the present invention and which, particularly with respect to standard features of a shoe, which having some similarities to the present invention, are not characterized by providing the improvements obtained by the present invention.

More particularly, with regard to U.S. Pat. No. 1,018,652, such discloses a shoe retainer which includes a strip of elastic material or tape 2 which is fixedly secured, preferably by stitching 3, at its upper edge to the inner face of the upper edge portion of the heel of the shoe. U.S. Pat. No. 1,138,473 discloses a rubber tube a which is laid upon a strip b of velvet, chamois leather, or other suitable fabric, which is then doubled or folded around the tube a with the two layers of material being stitched or otherwise secured together to hold the rubber tube in place and leave a flange portion c for attachment to the shoe.

U.S. Pat. No. 1,392,628 discloses a shoe retainer having a body portion of canvas or other suitable material 1, the convex surface of the body portion being provided with a layer 2 of suitable gum which, when moistened, becomes adhesive. Secured to the body portion interiorly at its upper edge is a strip of elastic material 4 which may be retained in position by stitches 5 or other suitable means extending to the upper edge and the two ends thereof.

U.S. Pat. No. 1,812,622 discloses in FIG. 2 thereof the utilization of outer quarters 1,1, inner quarters 2,2 and a heel-opening counter 3. A sole counter 4 and inner sole 5 are also shown wherein a pad 6 made of a resiliently compressable material is interposed between the inner and outer quarters 1,2. This pad is preferably convex on one face 7 so that when it is covered by the inner quarter piece, the same will be bulged inwardly on the shoe and the foot of a person wearing the shoe will be snugly engaged at the bulged portion.

U.S. Pat. No. 1,028,586 is characterized by disclosing a shoe retainer which is provided with a strip of soft, resilient and preferably water-proofed material such as vulcanized rubber. The strip of material is preferably narrower at its median portion to constitute a neck 2 and includes ends 3 preferably downwardly turned and enlarged. A portion of the neck 2 of the strip is beveled or tapered to remove as far as possible any joint or abrupt shoulder being formed between the lower edge of the strip and the inner rear surface of the heel of the slipper. On opposite ends of the strip 1 there are formed elongated hollow blister-shaped ridges 5 which are preferably formed so as to constitute inwardly extending projections bearing against the foot near the ankle of the user immediately above the heel to grasp the same sufficiently firmly to assist in retaining the shoe on the foot of the individual. These strips are preferably coated on the rear faces thereof with rubber cement and are thus fixedly secured to the inner rear ball of the heel of the slipper near the top, with the reduced or beveled portion 4 being arranged centrally over the Achilles tendon on the person wearing the shoe. The bridges 5 are disclosed as being hollow and the strip is indicated as being composed of elastic material, the walls of the ridges 5 being normally maintained in an expended condition while the main rear surface of the strip is adhered to the inner face of the shoe. As an alternative, the strips may be secured to the shoe by sewing, as disclosed therein.

Lastly, Applicant further notes that U.S. Pat. No. 1,878,419 discloses a shoe which has a heel portion which includes an upper 1, a counter stiffener 2 of comparatively stiff material and a lining 3 secured to the inner surface of the counter. At each side of the heel portion of the shoe, an elastic body 4 of soft rubber or equivalent material is provided. These bodies 4,4 are secured between the counter 2 and the lining so that their convex inner surfaces cause the lining to form similarly inwardly convex, extended portions 5 arranged such that they extend into the cavities provided at the sides of the tendons of the person wearing the shoe and are located near the ankle joint. As described therein, the elastic bodies 4 are preferably glued, cemented or otherwise secured to the counter without the use of any metallic fastener devices, as it is desirable to maintain complete elasticity.

Each of the foregoing retainers are characterized by being fixedly secured to the interior portion of the lining of the counter and thus require at least a partial destruction thereof when it becomes necessary to replace the padding for the shoe retainer or if it becomes desirable to increase the holding ability of the retainer by substituting one retainer elastic member for another. This therefore causes a serious disadvantages in terms of flexibility of use or interchangeability of the retainer.

With regard to the heel cups shown in U.S. Pat. No. 2,379,000, U.S. Pat. No. 2,210,332; U.S. Pat. No. 1,417,170; U.S. Pat. No. 1,544,065 and U.S. Pat. No. 32,487, it is noted that while recessed heel portions are set forth in each of these references, they do not teach any recognition of the same being capable of a reduction of heel slippage nor do they assist individuals having narrow heels or those wearing an orthotic device in properly stabilize the heel of the individual or to provide improved comfort to the person wearing the shoe.

One general observation of the above-noted prior art is that all of the retainers are positioned below and rearward of the ankle bone of an individual, which is functionally inappropriate. In addition, all of the shoe retaining devices that wrap or continue from one side of the shoe, around the heel, to the opposite side are biomechanically unsound because they push the foot forward in the shoe. In addition, the prior art requires adhesives for being secured in place and/or are sewn into position. It has therefore become desirable to provide an insert which does not require direct adhesives or direct stitching for proper positioning during manufacturing.

SUMMARY OF THE INVENTION

One object of the present invention is to provide an insert which can be secured in position without being directly sewn or adhered to the interior portion of the shoe.

A further object of the present invention is to provide a shoe with such an insert. The shoe may specifically comprise a woman's dress shoe that has a low vamp or no vamp such as a pump or related type of shoe. The outsoles of the shoes have to be technologically developed to stabilize prescribed orthotics or insole inserts so that air/foam pockets or "heel snuggers" within the side counter (calcancocuboid and calcaneotalus area) grip the heel of the foot and keep the heel of the person from slipping within the shoe. Some women's shoes have been designed to try and accommodate orthotics with added depth within the upper construction of a shoe which then sits on top of an outsole, but never with the specific stabilizing outsole developed in accordance with the present invention. Without the stabilizing outsole and the air/foam pockets, patients with orthotics or individuals with inserts have difficulty with the orthotics and/or inserts slipping within the shoe, and hence, shoes tend to slip off their feet.

An additional object of the present invention is to provide a combination of a heel cup outsole formed over semi-rigid material that stabilizes an orthotic or orthotic insert within the shoe in order to receive the calcaneus (heel) of the wearer during the individual's gate in the same position in every step so that the second part of the air/foam pockets can grip the calcaneus area of the outside of the foot at or on the rear of the subtalar joint and proceed forward over the subtalar joint up to the calcaneocuboid joint (FIG. 12). The air/foam pocket for the inside of the foot starts at or on the rear of the talus and proceeds forward over the subtalar joint and talocrural joint up to the head of the talus (most forward end of the talus) (FIG. 13).

A further object of the present invention is to provide a device for preventing slippage of the heel of a woman's shoe, to obtain a molded heel cup to provide comfort and stability to the heel of an individual wearing the shoe and to provide an appropriate method by which the device for preventing slippage and the molded heel cup are attainable.

A further object of the present invention is to overcome the drawbacks noted above with respect to the known prior art by providing a more effective device for preventing slippage of the heel of a woman's shoe and providing a more effective molded heel cup with respect to the comfort and stability of the heel of the individual wearing the shoe.

In accordance with the present invention, a foot gripping device for a shoe is provided which utilizes a heel portion having a counter with an inner lining into which the heel of the individual wearing the shoe is positionable, at least one strip of material being secured to the lining wherein the strip of material forms a tunnel which is open at at least one end thereof, and an insert removably positioned within the tunnel, the insert reducing the width dimension of the heel portion of the shoe and being engageable with the side portion of the heel of the individual so as to resist slippage of the heel from the shoe.

A further object of the invention is to utilize an elastic material for the material within which the insert is placed to also arrange for the insert to be elastic in nature.

An additional object of the present invention is to have the elastic material extend from a position in proximity with the counter and extends towards the toe portion of the shoe. In addition, the tunnel may be opened at opposite ends of the strip of material so as to permit easy insertion therein of the insert from either end of the tunnel formed by the material.

In view of the fact that the tunnel is provided to permit easy use and replacement of the inserts fittable therein, it can be understood that the strip of material itself may be secured to the lining by being either sewn or glued thereto as long as such is properly fixed in place. Lastly, the insert may comprise a strip of any type of flexible material, although cellular foam is preferred.

The present invention also serves to provide a method of resisting slippage of the heel of the shoe wherein the strip of material is formed so as to have at least one open end. The method also includes the step of removably inserting an insert into the at least one open end of the strip of material so as to prevent resistance to slippage of the heel of the individual from heel portion of the shoe. The method is further characterized by securing of the strip of inaterial by stitching and/or glueing of the material to the lining of a counter so as to form the tunnel.

A further object of the present invention is to provide a heel cup for a shoe which includes either a midsole or outsole which is positionable in the shoe, the midsole or outsole having a cup portion which extends from a heel portion of the shoe to a position in proximity with an arch support of the shoe so as to provide comfort to the person wearing the shoe and to achieve the goal of stabilizing the heel of the individual within the heel portion of the shoe. The corresponding method includes the step of positioning the midsole or outsole having the cup portion into the shoe such that the cup portion extends from a heel portion of the shoe and extends to a position at proximity with the arch support portion of the shoe.

An additional object of the present invention is to provide a shoe which includes both the device for preventing slippage of the heel of the person wearing the shoe in combination with the molded heel cup so as to permit the shoe to have the resultant advantages described above.

BRIEF DESCRIPTION OF THE DRAWINGS

Various objects, feature and attendant advantages of the present invention will be readily understandable by reference to the accompany drawings forming a part of the present invention wherein.

DESCRIPTION OF THE PREFERRED EMBODIMENTS

Figure 1:
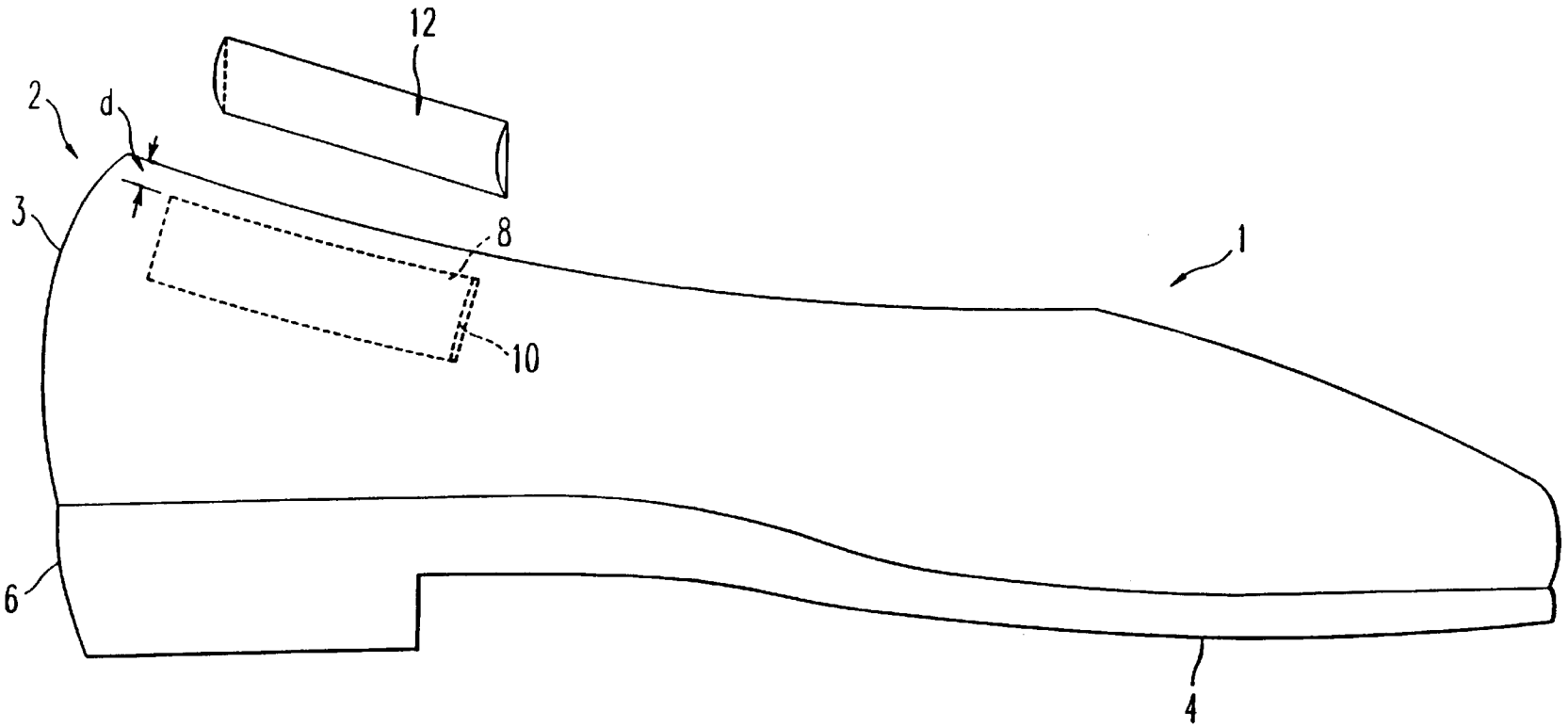
FIG. 1 is a side elevation view showing the manner in a first embodiment in which the inserts are positionable within the strips of material forming the tunnel.
Figure 2:
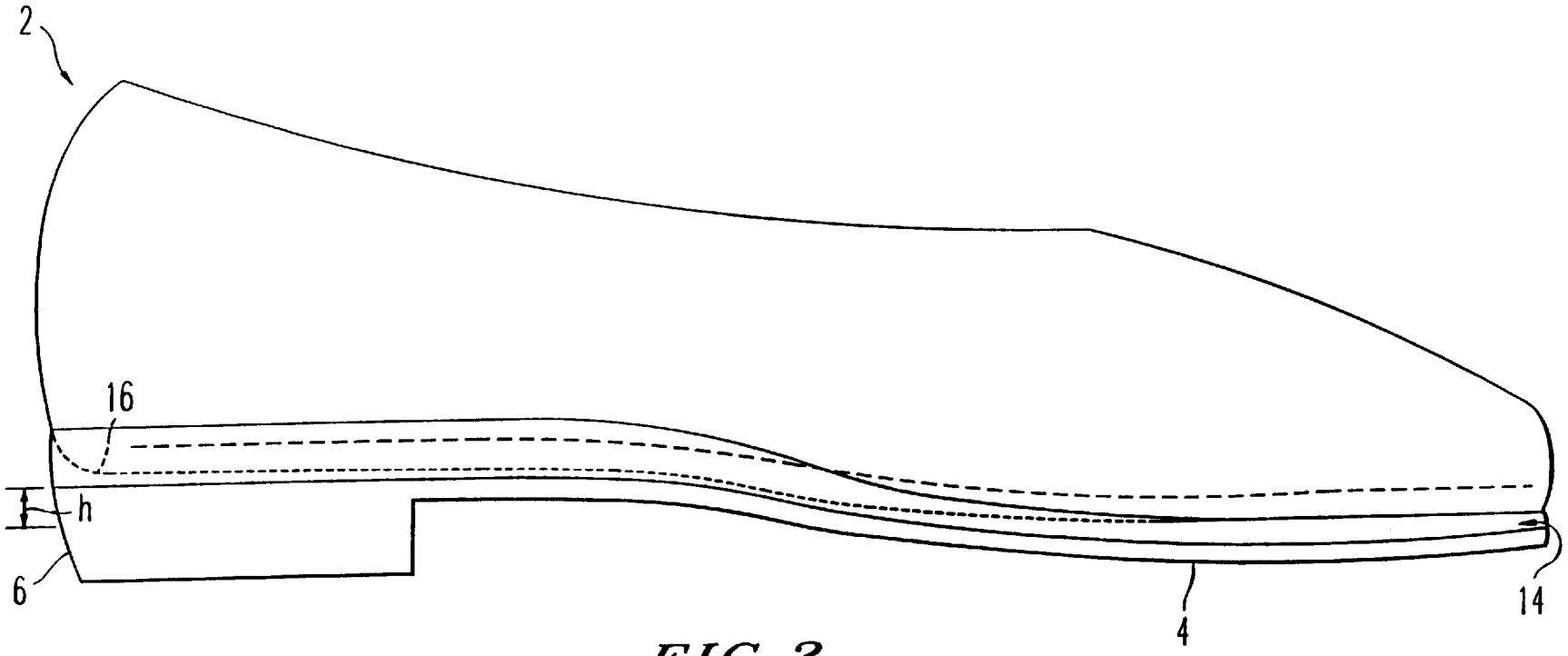
FIG. 2 is a similar view to that of FIG. 1 but which serves to illustrate the location of the cup support which extends from a rear portion of the heel of the shoe up to a position located in proximity with the arch support so as to eliminate sagging of the arch and to keep the arch support in place even upon experiencing extended wear.
Figure 3:
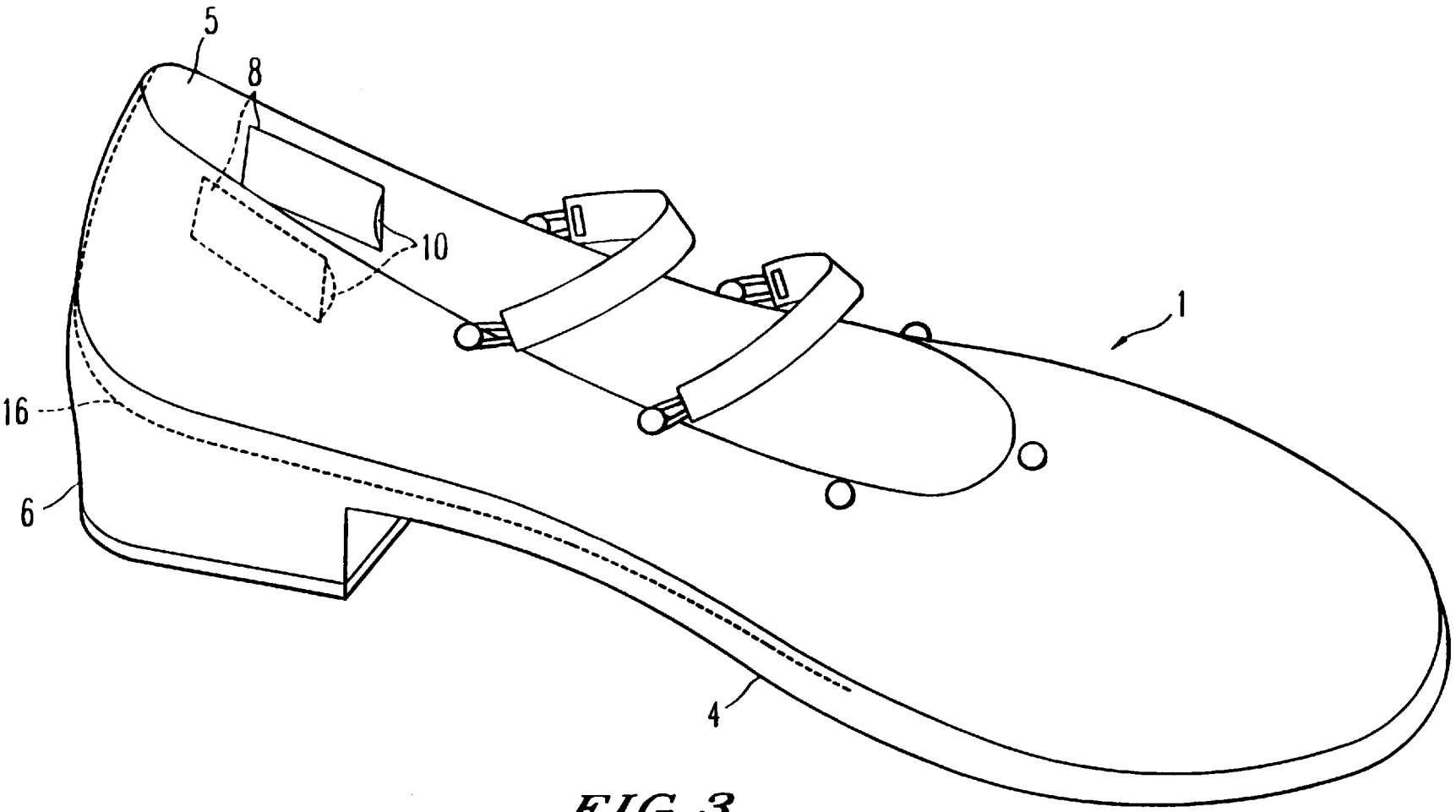
FIG. 3 serves to illustrate an embodiment of the present invention which utilizes both the device for preventing slippage of the heel and the recessed heel cup shown in FIG 2.

As illustrated in FIG. 1–3, a first embodiment of the present invention is characterized in a first embodiment thereof by providing a foot gripping device for a shoe 1 which includes a heel portion 2 and a sole of the heel portion having a counter with a lining 5. The shoe is provided with a lower heel 6. On opposite sides of the upper opening of the shoe, strips of material 8 are provided which have openings at opposite ends thereof and which therefore form a tunnel 10 within which replaceable foam inserts 12 are positionable. The inserts are therefore located a predetermined distance d from the upper edge of the opening of the shoe so as to permit the same to properly contact the heel of the individual wearing the shoe and to prevent slippage of the same.

As can be appreciated from the figures, the device for preventing slippage of the heel of the wearer has been created to help keep the individual's heel in the shoe when being worn. Along with this, shoes in the present invention can be provided with a molded heel cup which serves to lower the heel of the individual and the shoe such that the shoe will aesthetically have the appearance of a 1 inch heel as viewed from the outside whereas in fact the shoe may only have a ⅜ inch heel. In FIG. 2, the symbol h represents the actual heel height of approximately ⅜ inches. The device for preventing slippage of the present invention can be utilized without the heel cup described above, but when used in combination with the heel cup, the device for preventing slippage of the heel of the individual works in an even more desirable manner.

As will be understandable to one of ordinary skill in the art, the sides of the heel of an individual has a contour that gets narrower from the bottom of the foot upwardly to the ankle. The device for preventing slippage of the heel is designed to fit in this portion within the shoe. Heel slippage is a common problem for women, for example, who have proportionately narrow heels or for women wearing an orthotic. The present invention, upon being installed in a typical pump, is both comfortable and achieves the goal of stabilizing the heel of the individual within the heel of the shoe.

The location of the foam inserts 12 within the peripheral material 8 forming the tunnel 10 can vary with the design of the shoe. This device, however, typically starts from the counter and runs from a distance d of ⅜ inch to ¼ inch from the throat or top line, toward the vamp. A strip of stretchy (i.e. elastic) material which may be, for example, 2 inches by ½ to ⅝ inch in terms of length and height, is attachable by being sewn and/or glued or in any other preferred manner into the inner lining of the shoe, in a lengthwise manner. The material will be attached only on the top and bottom (along the 2 inch lengths) leaving one or both ends open so as to create a tunnel of material. There are two tunnels 10,10 per shoe, starting and ending at substantially the same location of either side of the interior of the shoe as described. When viewing the shoe from above, these tunnels are symmetrically positioned directly across from one another.

The foam inserts 12 may comprise strips of cellular foam with a stiff backing and may be of various shapes and sizes but it is preferable that the same are not greater than ½ inch wide or more than two inches long so as to be easily insertable into the tunnels 10 formed in the strips 8 of material. These various removable foam shapes serve to eliminate slippage of the heel of the individual wearing the shoe and can be selected by the customer, if desired, so as to customize the fit to the degree to which slippage of the heel can be prevented. The replaceable inserts thus allow the heel width to vary not only among different customers who purchase shoes of this type may also vary from foot to foot and from day to day for the same individual.

While FIG. 1 primarily illustrates the device for preventing slippage of the heel, FIG. 2 and 3 serve to illustrate the hidden depth of shoe concept of the invention set forth therein as provided by the molded heel cup. As can be appreciated from review of FIGS. 2 and 3, a midsole or outsole 14 is provided in the shoe and a molded heel cup 16 is positionable within the shoe wherein the dotted lines illustrate where the insert or an orthotic will rest. It is the midsole or outsole 14 that is cupped from the arch to the heel wherein the cup ends just prior to the ball of the foot so that an individual wearing of the shoe with a wider foot who needs a wider width won't feel the ridge of the cup. The cup support in the arch serves to eliminate sagging and maintains the arch support in place even after extended wear. The illustration shown in FIG. 3 includes a dotted line which indicates the level at which the heel of the individual wearing the shoe rides within the shoe and also serves to illustrate the fact that the device for preventing slippage can also be utilized in conjunction with the heel cup.

As can be appreciated from the foregoing, the method of resisting slippage of the heel of an individual and the heel portion of the shoe includes the step of securing the strip material to the lining located on a counter provided in the heel portion of the shoe such that the strip of material forms at least one open end 10. This is followed by removably inserting the insert into the at least one open end of the strip of material so as to resist slippage of the heel of the individual from the heel portion of the shoe when a shoe is being worn.

It is further understood that the heel cup support for the shoe can be constructed by positioning a midsole or outsole having a cup portion into the shoe such that the cup portion extends from the heel portion of the shoe and extends to a position in proximity with an arch support of the shoe.

Figure 5:
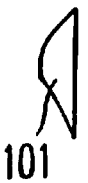
FIG. 5 is a side view of the air/foam material of the insert for the second embodiment.
Figure 6:
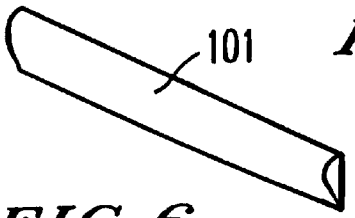
FIG. 6 is a perspective view of the second embodiment.
Figure 4:
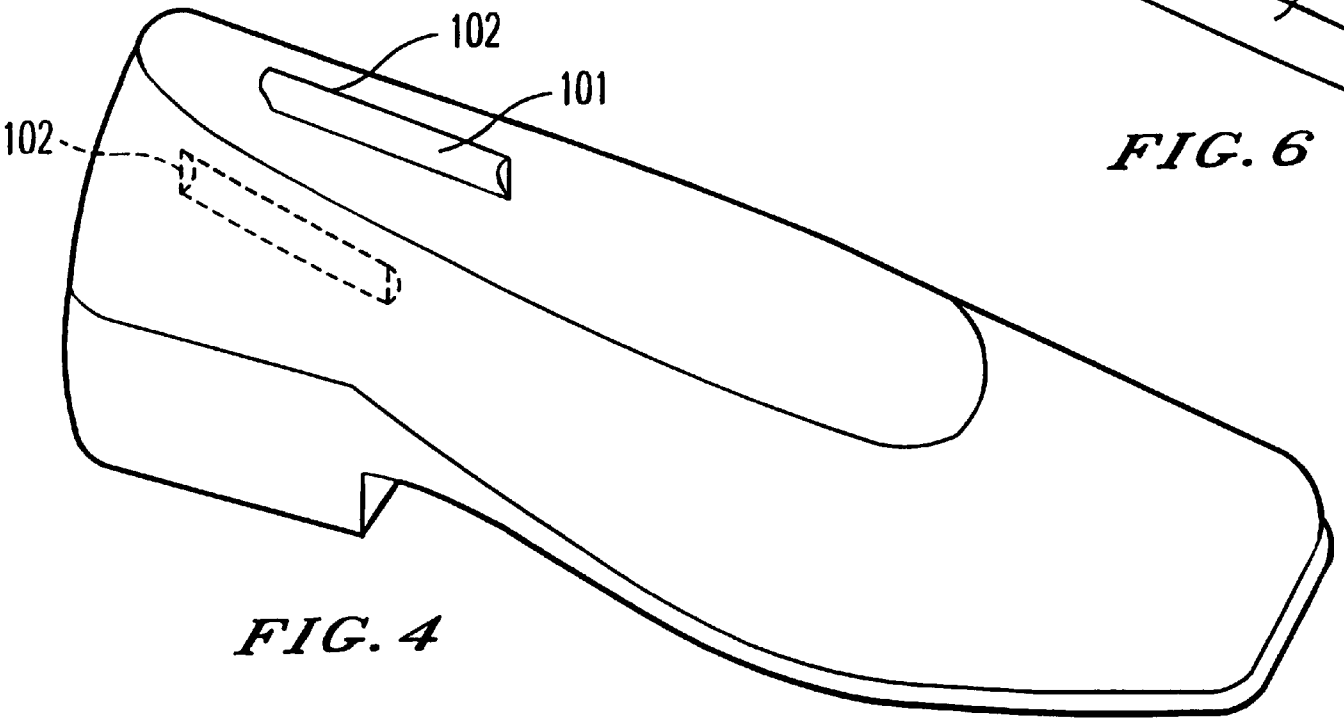
FIG. 4 is a perspective view of the stabilizing outsole and air/foam pockets or "heel snuggers" in accordance with the second embodiment.
Figure 7:
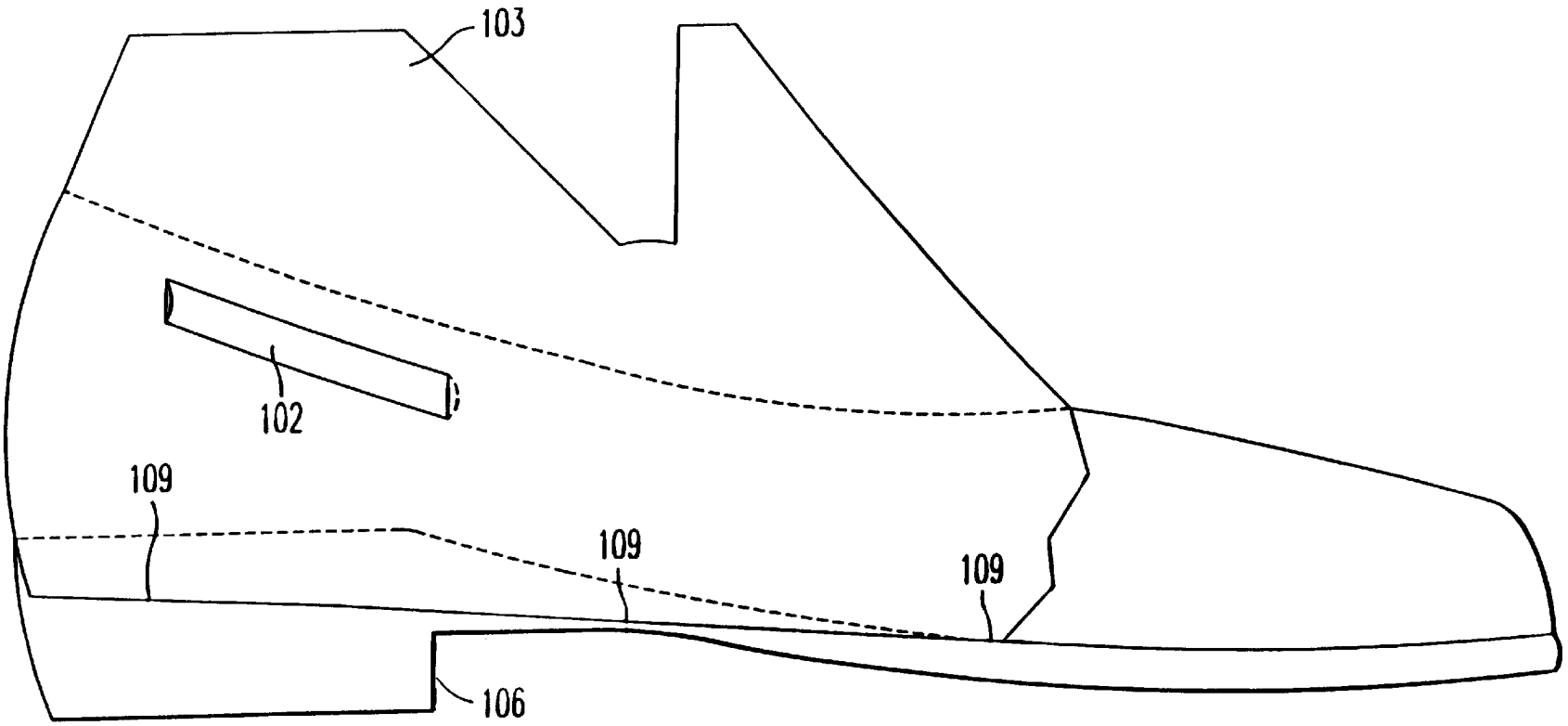
FIG. 7 is a view of a lasted shoe with the leather and outer edge of the outsole being shown peeled away from the metatarsal area to the rear of the shoe.

As can be appreciated from a review of FIGS. 4–10 showing the second embodiment of the present invention, the purpose thereof is to be functional in effectively providing resistance of slippage of the heel of the individual. The shoe is manufactured so that each component of the second embodiment is precisely placed for the proper results. In this regard, in this embodiment, an air/foam celled insert 101 is illustrated in FIG. 4 which is of, but not limited to, opened celled foam properties. The air/foam insert 101 is elongated as shown in FIG. 6 and is contoured from the top edge thereof to the bottom edge thereof as shown in FIG. 5. A last 103 is grooved to form a pocket or recessed area 102 as shown in FIG. 7 and which receives the air/foam insert 101. This open faced hollowed-out or grooved portion or recessed pocket 102 of the last 103 allows the air/foam insert to maintain its integrity during the manufacturing process and thus create insert 101 so as to be of appropriate dimensions within the pocket without distorting the throat or top line of the shoe which otherwise occurs in the prior art. The air/foam insert 101 is removably placed in position without the need for adhesive or stitching within the pocket 102 which thus clearly provides advantages in terms of ease of construction of the shoe. Adhesives are not used so that the air/foam insert 101 will not absorb the chemical components of the adhesives which would otherwise cause stiffening or malfunctioning of the air/foam insert. Thus, the air/foam insert illustrated in FIG. 8 maintains its shape under the inside lining of the shoe. The air/foam insert 101 is removable and is positionable beneath the inside lining 116 and is located on top of a sheet 105. The inside shoe lining within the counter 107 and the sheet 105 are attached or secured by means of adhesives and/or are stitched along the counter back line 104 of the heel of the shoe, as well as, along the top line or throat 108 of the shoe.

Figure 8:
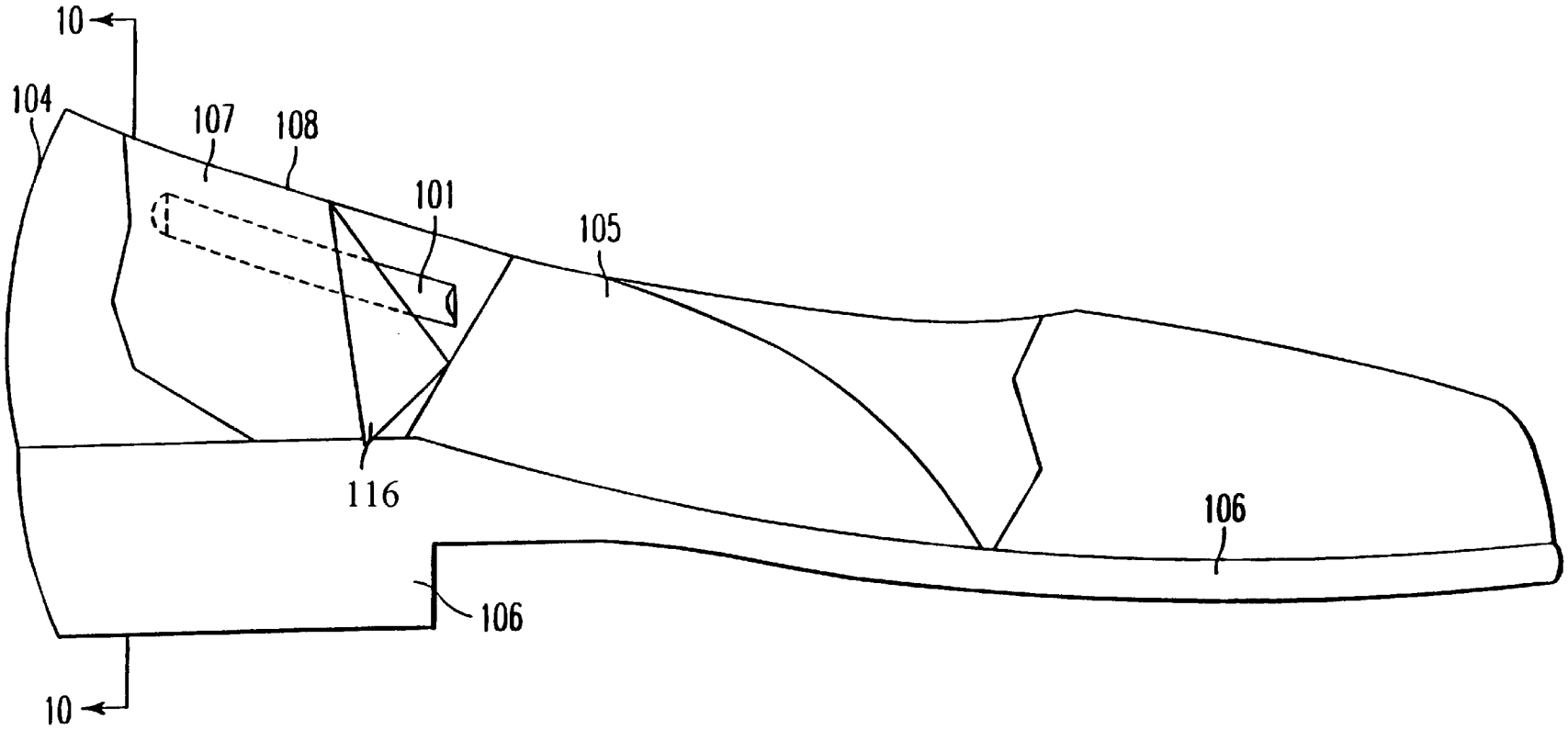
FIG. 8 is a side view of the right shoe with the right sole upper materials removed to show the left inside portion of the shoe.
Figure 9:
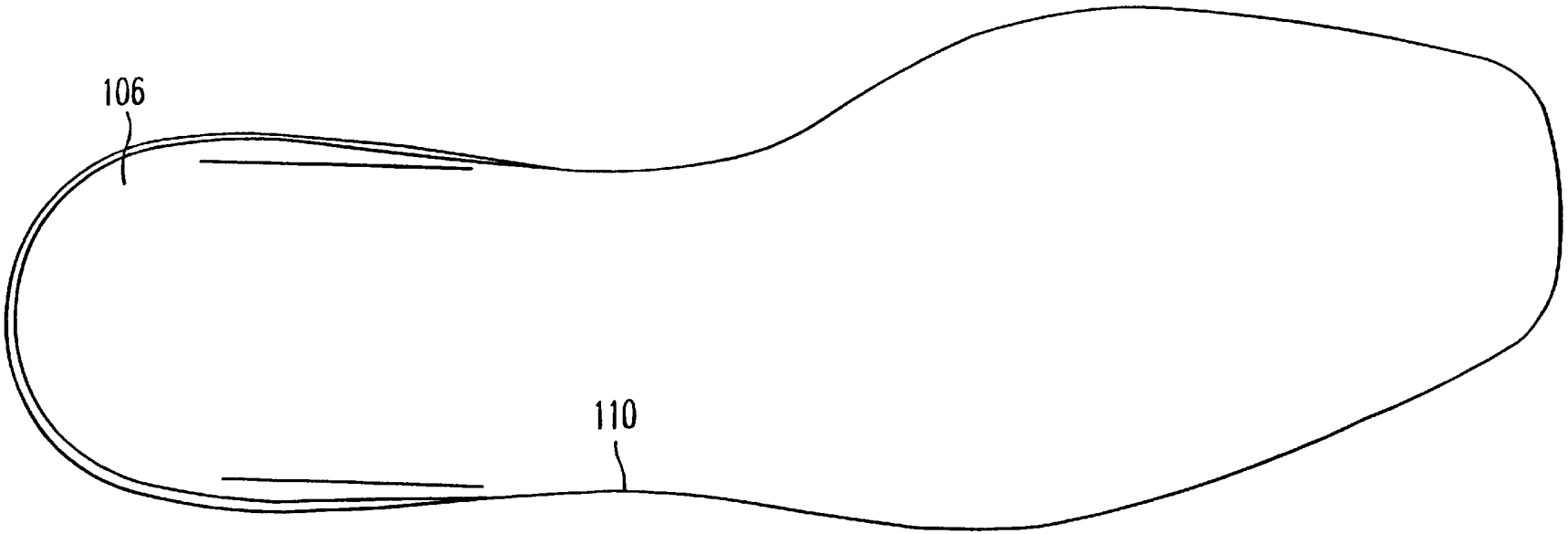
FIG. 9 is a top view of the heel cupped outsole.
Figure 10:
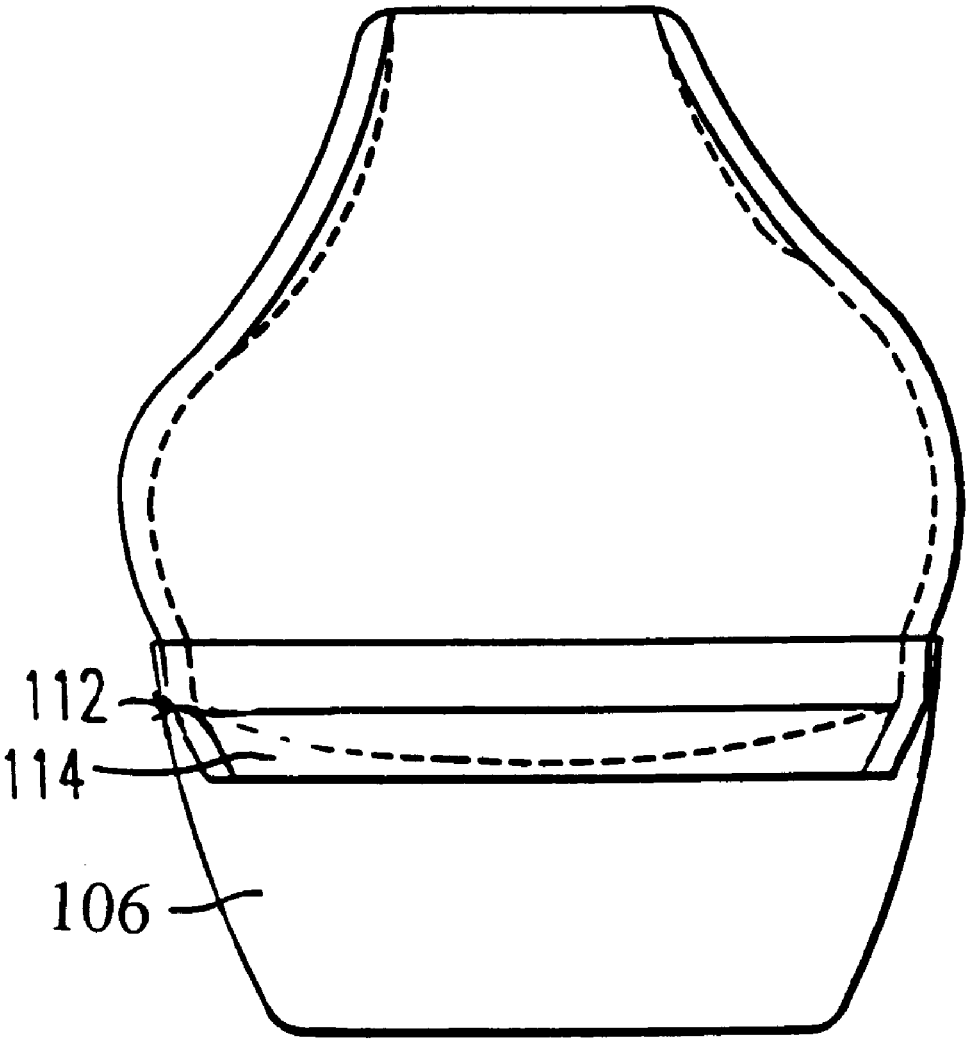
FIG. 10 is a rear cross-sectional view of the shoe taken along lines 10—10 of FIG. 8.

The outsole 106 as shown in FIGS. 7 and 8 is made of a semi-rigid material and has a gradual sloping drop from the heel to the metatarsal area 109. From the top view of the outsole 106, the heel is wider than the arch 110 so that an orthotic will not slide forward during a normal gate of the individual wearing the shoe. The rim or edge of the heel cup 1 12 is semi-rigid so as not to allow an orthotic or orthotic insert to move sideways within the shoe. The heel cup in this embodiment thus corresponds to that shown in the first embodiment. Also shown in FIG. 10 is a insole 114.

Figure 11:
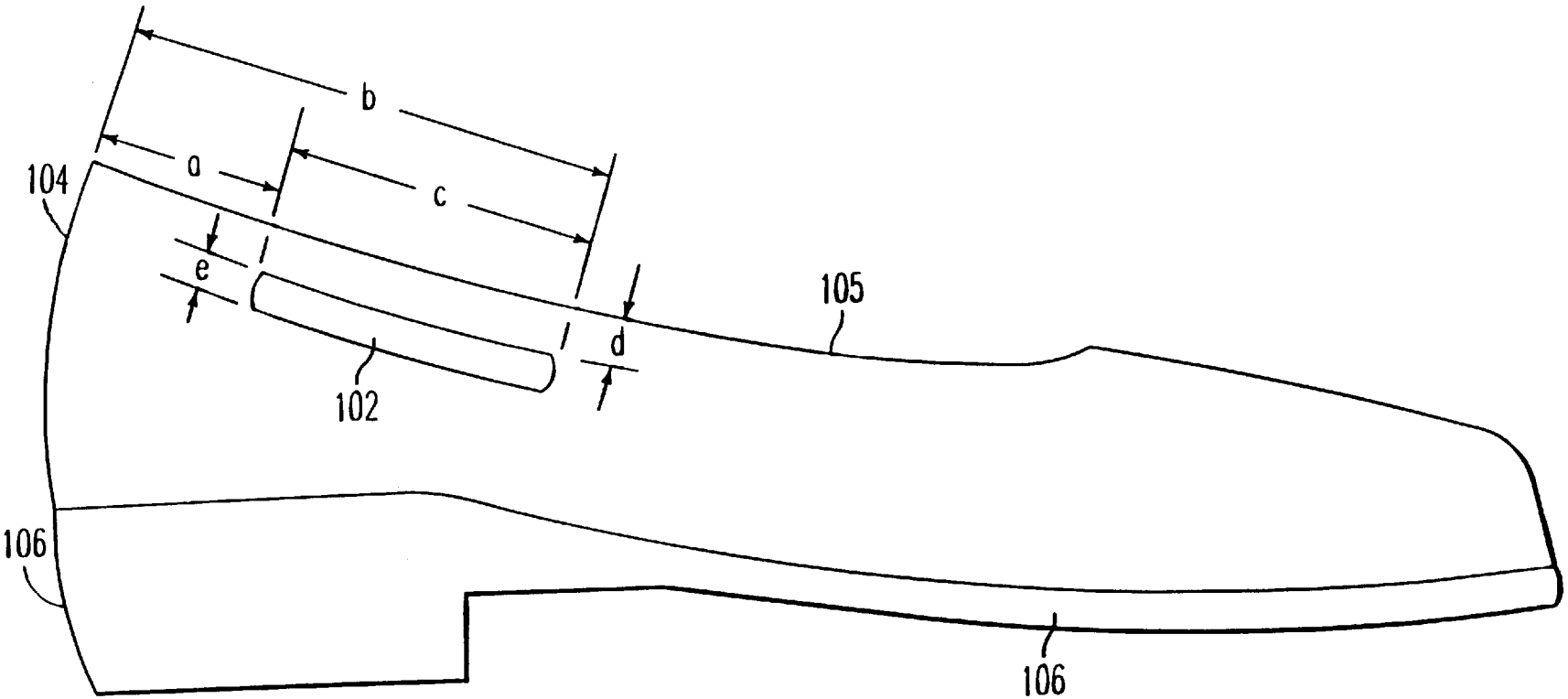
FIG. 11 shows the dimension regarding the preferred location of the insert.

FIG. 11 illustrates the preferred dimensions regarding the location of the insert. These dimensions are substantially as follows:

a=1⅜ inches b=3⅜ inches c=2 inches d=5/16 inches

Dimension a is measured in a forward direction from the back heel stitch line of the shoe. As can be appreciated from FIGS. 1–8 and 11–13, the insert 101 is substantially longitudinally extending and is equidistantly spaced from the top line or throat 108 by distance d.

Figure 12:
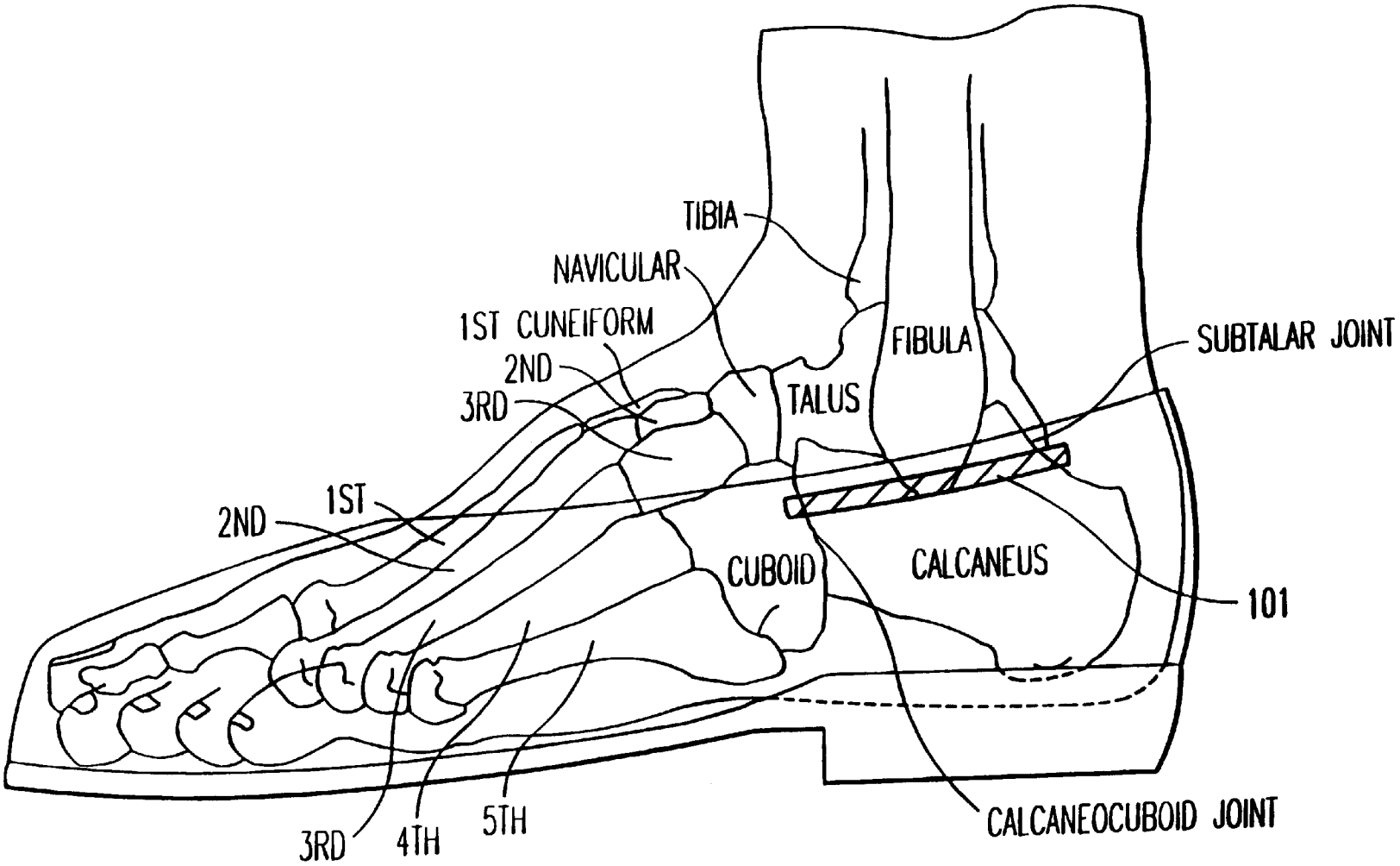
FIGS. 12 and 13 illustrate the structure of the foot of an individual as it relates to the inserts of the present invention.
Figure 13:
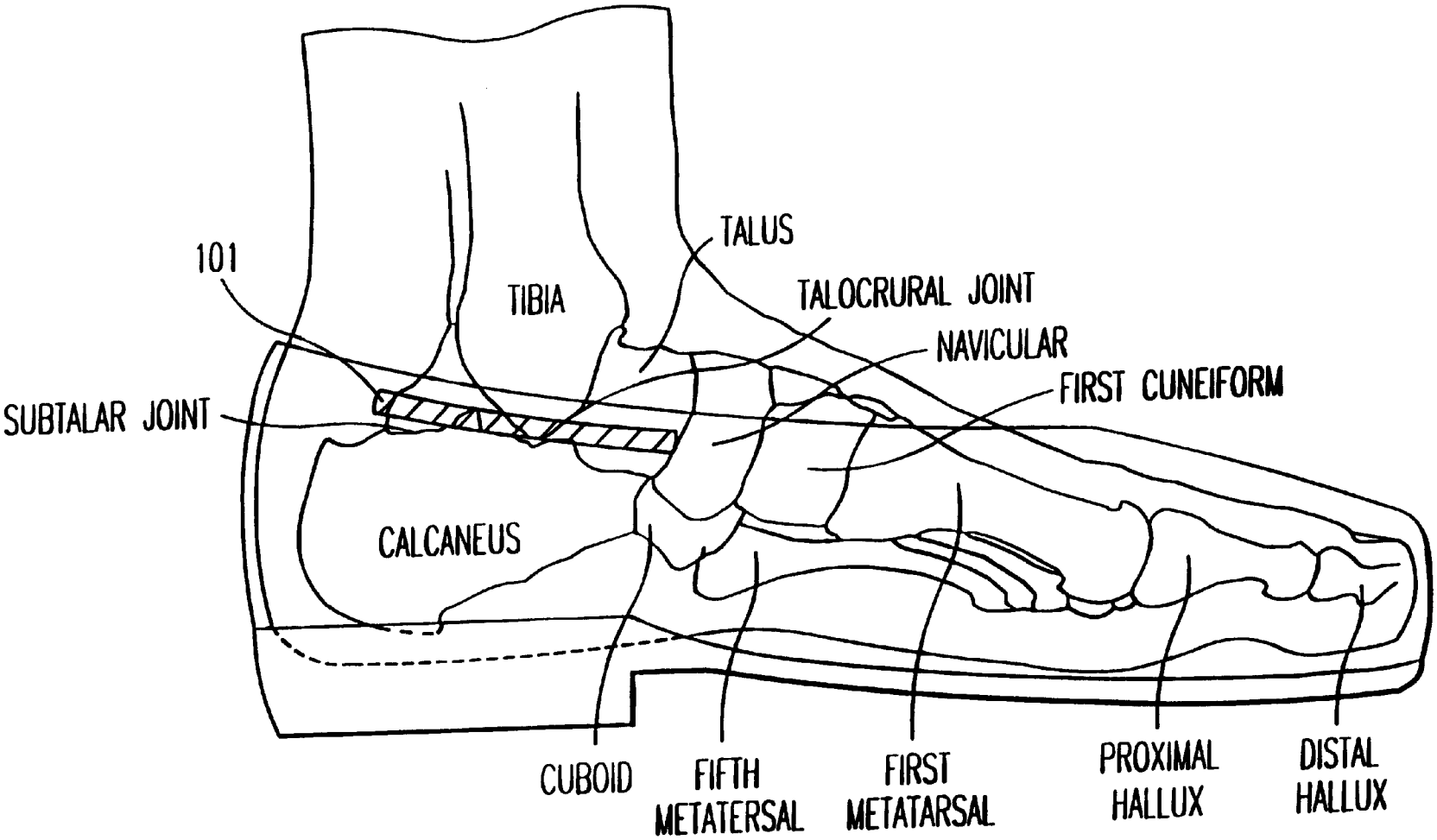

FIGS. 12 and 13 illustrates a lateral view and a medial view, respectively, of the various components of an individuals foot as it relates to the position of the insert of the present invention.

Further objects, features and attendant advantages of the present invention will be understandable to one of ordinary skill in the art and variations on the present invention are considered to be within the scope of the present invention.

What is claimed is:

1. A method of constructing a shoe, which comprises:

forming a pair of spaced apart, open faced pockets in an interior portion of a last for assembling the shoe;

securing inserts within the pockets and beneath a lining of the shoe located in a counter of the shoe wherein said inserts are positioned below an upper edge of the counter and are completely enclosed beneath said lining;

securing said lining to said counter; and positioning a sole member having a cup portion into the shoe such that the cup portion extends from a heel portion of the shoe to a position in proximity with an arch portion of the shoe so as to make the shoe more comfortable for an individual wearing the shoe and to provide stabilization of a heel of the individual wearing the shoe, said inserts being positioned so as to extend a substantially uniform distance from a top line portion of the shoe, and said inserts reducing a width dimension of an upper opening and the heel portion of the shoe so as to be engageable via said lining with a side portion of a heel of an individual.

2. A method of resisting slippage of a heel portion of a shoe when worn by an individual, which comprises:

forming a pair of spaced apart, open faced and longitudinally extending pockets on inner surfaces of a last on which the shoe is to be assembled, the shoe having a counter and a lining;

positioning a substantially longitudinally extending insert into each of said pair of pockets so as to resist slippage of the heel of the individual from the heel portion of the shoe said inserts being completely enclosed beneath said lining of the shoe at a position located beneath an upper edge portion of said counter.

3. A method as claimed in claim 2, which comprises securing a sheet over the insert so as to hold the insert of material in place.

4. A method as claimed in claim 3, wherein the securing of the sheeting comprises one of adhering and of stitching the sheets to said counter.

5. A method as claimed in claim 2, wherein the insert comprises a resilient insert.

6. A method as claimed in claim 2, wherein said insert comprises an open celled insert.

* * * * *